US008527267B2

(12) United States Patent
Carroll

(10) Patent No.: US 8,527,267 B2
(45) Date of Patent: Sep. 3, 2013

(54) ADDING ADDITIONAL DATA TO ENCODED BIT STREAMS

(75) Inventor: Timothy J. Carroll, Lancaster, PA (US)

(73) Assignee: Linear Accoustic, Inc., Lancaster, PA (US)

( * ) Notice: Subject to any disclaimer, the term of this patent is extended or adjusted under 35 U.S.C. 154(b) by 754 days.

(21) Appl. No.: 12/631,773

(22) Filed: Dec. 4, 2009

(65) Prior Publication Data

US 2010/0145713 A1 Jun. 10, 2010

Related U.S. Application Data

(60) Provisional application No. 61/119,819, filed on Dec. 4, 2008.

(51) Int. Cl.
*G10L 21/06* (2013.01)

(52) U.S. Cl.
USPC ..... 704/229

(58) Field of Classification Search
USPC ..... 704/219–230
See application file for complete search history.

(56) References Cited

U.S. PATENT DOCUMENTS

| | | | | |
|---|---|---|---|---|
| 5,913,190 | A | 6/1999 | Fielder et al. | |
| 6,560,496 | B1 | 5/2003 | Michener | |
| 6,807,528 | B1 * | 10/2004 | Truman et al. | 704/229 |
| 6,915,263 | B1 | 7/2005 | Chen et al. | |
| 7,009,999 | B2 | 3/2006 | Dickson | |
| 7,088,907 | B1 * | 8/2006 | Nishijima et al. | 386/248 |
| 7,251,241 | B1 | 7/2007 | Jagadeesan et al. | |
| 2007/0208571 | A1 * | 9/2007 | Lemieux | 704/500 |
| 2008/0270143 | A1 | 10/2008 | Metz | |
| 2009/0063159 | A1 * | 3/2009 | Crockett | 704/500 |

FOREIGN PATENT DOCUMENTS

EP 1020998 7/2000

OTHER PUBLICATIONS

"ATSC Implementation Subcommittee Finding: PTS Time Stamping AC-3 Bit Streams", Advanced Television Systems Committee, Doc. IS/161, 1-6-00, Updated Feb. 28, 2003.

"DP569 Dolby Digital Encoder Quick Start Guide", Version 2.0.0.1, 2001 Dolby Laboratories, Inc.

* cited by examiner

*Primary Examiner* — Abul Azad
(74) *Attorney, Agent, or Firm* — Renner Otto Boisselle & Sklar LLP

(57) ABSTRACT

A method of adding additional data to encoded bit streams may include receiving a signal containing an encoded data frame, where the encoded data frame includes a plurality of data blocks. The method may further include transforming the encoded data frame into a modified encoded data frame by inserting at least one additional data block between a synchronization information block and an error check block, where the at least one additional data block includes the additional data, and modifying data in at least one of the synchronization information block and the error check block to account for the inserting of the at least one additional data block.

17 Claims, 7 Drawing Sheets

ADDING ADDITIONAL DATA TO ENCODED BIT STREAMS

CROSS REFERENCE TO RELATED APPLICATIONS

This application claims the benefit of provisional application No. 61/119,819 filed on Dec. 4, 2008, which is incorporated herein by reference.

BACKGROUND

This patent application describes a novel invention related to data compression. The invention described herein relates to the insertion of data into a previously encoded bit stream and to the extraction of such data. The data may be related or unrelated to the content of the previously encoded bit stream.

The subject matter disclosed here may find particular application in the fields of broadcast and consumer audio. Modern distribution of audio signals to consumers involves the use of data rate reduction or audio compression techniques to lower the required amount of data required to deliver audio signals to consumers while causing minimal impact to the original audio quality. The reduction in the size of the data translates into savings of transmission and storage bandwidth, thereby allowing cost savings and/or carriage of more programs in a given space.

Systems including AC-3, DTS, MPEG-2, AAC and AAC-HE are examples of common audio data reduction techniques. For the purposes of this application, the AC-3 system will be used as an example, but the invention may be applicable to any codec system, audio or video.

Audio data compression lowers the amount of data required for transmission and/or storage of a given audio quality target. The resulting data produced by the compression process depends on the input audio and the audio quality target and, as such, it's data rate varies over time. Unused null, stuffing, or dummy bits may be inserted to maintain a constant output rate.

This unused data space may be used to carry additional data. This technique is described in U.S. Pat. No. 6,807,528 ("Adding Data to a Compressed Data Frame") . A drawback of this approach is that continuous extra data may not always be available.

BRIEF SUMMARY

Data of any type may be inserted into an already encoded bit stream. Structure may be provided that: (i) accepts an incoming compressed data stream and inserts additional data that may be related to the compressed data stream; and/or (ii) accepts an incoming compressed data stream and inserts data that may not be related to the compressed data stream; and/or (iii) accepts an incoming compressed data stream and inserts null data for the purpose of smoothing or rate shaping the output bit rate or data frame length to a fixed value; and/or (iv) accepts an incoming data stream and modifies existing information present in the original bit stream indicating data rate to show a new data rate equal to the original data rate plus the inserted data rate; and/or (v) a structure that can be implemented in any encoded bit stream including an AC-3 encoded bit stream.

In the case of AC-3, the data insertion process may be compatible with all professional and consumer decoders, and is transparent to all devices that transmit or otherwise carry AC-3 data from one point to another. Such devices may include so-called transport stream multiplexers which may be hardware or software based, DVD systems including both recorders and players, gaming devices, or any device capable of storing or replaying AC-3 data. Data can be inserted into bit streams with no need for decoding and re-encoding, and the data can be extracted without the need for decoding thereby preserving audio quality. Any data that is inserted can also be removed without decoding or re-encoding, thereby restoring the data rate to the original value. A constant data rate output may be created from bit stream inputs that may vary in data rate.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
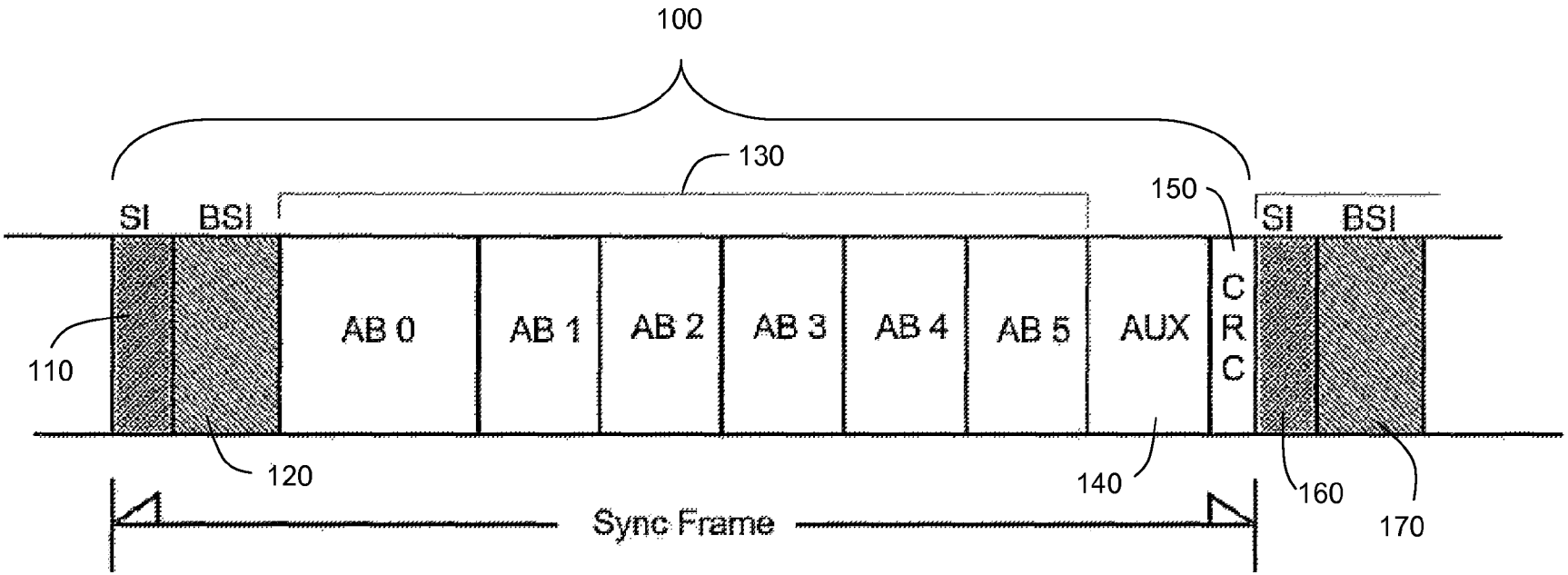
(Prior Art) Figure 1
FIG. 1 illustrates an example data structure or encoded data frame.

The following includes definitions of selected terms employed herein. The definitions include various examples, forms, or both of components that fall within the scope of a term and that may be used for implementation. The examples are not intended to be limiting. Both singular and plural forms of terms may be within the definitions.

As used in this application, the term "computer component" refers to a computer-related entity, either hardware, firmware, software, a combination thereof, or software in execution. For example, a computer component can be, but is not limited to being, a process running on a processor, a processor, an object, an executable, a thread of execution, a program, and a computer. By way of illustration, both an application running on a server and the server can be computer components. One or more computer components can reside within a process and/or thread of execution and a computer component can be localized on one computer and/or distributed between two or more computers.

"Computer-readable medium," as used herein, refers to a medium that participates in directly or indirectly providing signals, instructions and/or data. A computer-readable medium may take forms, including, but not limited to, non-volatile media, volatile media, and transmission media. Non-volatile media may include, for example, optical or magnetic disks, and so on. Volatile media may include, for example, optical or magnetic disks, dynamic memory and the like. Transmission media may include coaxial cables, copper wire, fiber optic cables, and the like. Transmission media can also take the form of electromagnetic radiation, like that generated during radio-wave and infra-red data communications, or take the form of one or more groups of signals. Common forms of a computer-readable medium include, but are not limited to, a floppy disk, a flexible disk, a hard disk, a magnetic tape, other magnetic media, a CD-ROM, other optical media, punch cards, paper tape, other physical media with patterns of holes, a RAM, a ROM, an EPROM, a FLASH-EPROM, or other memory chip or card, a memory stick, a carrier wave/pulse, and other media from which a computer, a processor or other electronic device can read. Signals used to propagate instructions or other software over a network, like the Internet, can be considered a "computer-readable medium."

"Data store," as used herein, refers to a physical and/or logical entity that can store data. A data store may be, for example, a database, a table, a file, a list, a queue, a heap, a memory, a register, and so on. A data store may reside in one logical and/or physical entity and/or may be distributed between two or more logical and/or physical entities.

"Logic," as used herein, includes but is not limited to hardware, firmware, software and/or combinations of each to perform a function(s) or an action(s) and/or to cause a function or action from another logic, method, and/or system. For example, based on a desired application or needs, logic may include a software controlled microprocessor, discrete logic like an application specific integrated circuit (ASIC) a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

An "operable connection," or a connection by which entities are "operably connected," is one in which signals, physical communications, and/or logical communications may be sent and/or received. Typically, an operable connection includes a physical interface, an electrical interface, and/or a data interface, but it is to be noted that an operable connection may include differing combinations of these or other types of connections sufficient to allow operable control. For example, two entities can be operably connected by being able to communicate signals to each other directly or through one or more intermediate entities like a processor, operating system, a logic, software, or other entity. Logical and/or physical communication channels can be used to create an operable connection.

"Signal," as used herein, includes but is not limited to one or more electrical or optical signals, analog or digital signals, data, one or more computer or processor instructions, messages, a bit or bit stream, or other means that can be received, transmitted and/or detected.

"Software," as used herein, includes but is not limited to, one or more computer or processor instructions that can be read, interpreted, compiled, and/or executed and that cause a computer, processor, or other electronic device to perform functions, actions and/or behave in a desired manner. The instructions may be embodied in various forms like routines, algorithms, modules, methods, threads, and/or programs including separate applications or code from dynamically and/or statically linked libraries. Software may also be implemented in a variety of executable and/or loadable forms including, but not limited to, a stand-alone program, a function call (local and/or remote) a servelet, an applet, instructions stored in a memory, part of an operating system or other types of executable instructions. It will be appreciated by one of ordinary skill in the art that the form of software may depend, for example, on requirements of a desired application, the environment in which it runs, and/or the desires of a designer/programmer or the like. It will also be appreciated that computer-readable and/or executable instructions can be located in one logic and/or distributed between two or more communicating, co-operating, and/or parallel processing logics and thus can be loaded and/or executed in serial, parallel, massively parallel and other manners.

Suitable software for implementing the various components of the example systems and methods described herein may be produced using programming languages and tools like Java, Pascal, C#, C++, C, CGI, Perl, SQL, APIs, SDKs, assembly, firmware, microcode, and/or other languages and tools. Software, whether an entire system or a component of a system, may be embodied as an article of manufacture and maintained or provided as part of a computer-readable medium as defined previously. Another form of the software may include signals that transmit program code of the software to a recipient over a network or other communication medium. Thus, in one example, a computer-readable medium has a form of signals that represent the software/firmware as it is downloaded from a web server to a user. In another example, the computer-readable medium has a form of the software/firmware as it is maintained on the web server. Other forms may also be used.

"User," as used herein, includes but is not limited to one or more persons, software, computers or other devices, or combinations of these.

Some portions of the detailed descriptions that follow are presented in terms of algorithms and symbolic representations of operations on data bits within a memory. These algorithmic descriptions and representations are the means used by those skilled in the art to convey the substance of their work to others. An algorithm is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, computing, calculating, determining, displaying, or the like, refer to actions and processes of a computer system, logic, processor, or similar electronic device that manipulates and transforms data represented as physical (electronic) quantities.

In one example, data structures may be constructed that facilitate storing data on a computer-readable medium and/or in a data store or that facilitate data transmission. Thus, in one example, a computer-readable medium may store a data structure that includes data fields or data blocks.

FIG. 1 illustrates an example data structure also known as an encoded data frame 100. For illustrative purposes, example data frame 100 has been chosen to be an encoded AC-3 frame as described in the Digital Audio Compression Standard (AC-3) document A52/A of the Advanced Television Systems Committee (ATSC) . However, unless otherwise claimed as such, the claimed invention is not limited to AC-3 and may be used with various other data compression systems or algorithms.

The example frame 100 includes a synchronization information (SI) block 110. SI block 110 may contain a sync word and information regarding sample rate and frame size. SI block 110 is followed by bit stream information (BSI) block 120. BSI block 120 may contain parameters describing the encoded data block 130. These parameters in BSI block 120 are sometimes also referred to as metadata or data about the encoded data. In the illustrated embodiment, encoded data block 130 contains six encoded audio blocks ABO-ABS. In other embodiments, encoded data block 130 may contain more or less than six encoded audio blocks. Frame 100 may also include an auxiliary data block (marked AUX) 140. The frame 100 is completed with an error check block (CRC) block 150 containing error checking information such as a CRC. A computer component and/or logic can determine if it has properly received the frame 100 based on data in CRC block 150.

The frame 100 begins with SI block 110 and ends with CRC block 150. The next frame begins when the next SI block 160 occurs followed by the next BSI block 170 and so on.

The bit stream may be carried over an electrical link in a format such as that described in IEC 60958, which is used to carry uncompressed digital audio signals that have a data rate many times higher than that of compressed audio. IEC 61937 describes example methods for carrying compressed audio over an electrical link. Other formats and links may be used for the interconnection. To keep the data rate of the interconnection fixed, lower rate compressed data may be burst out over time, and spaced by null bits to fill in the gaps and keep the frame length fixed.

Figure 2:
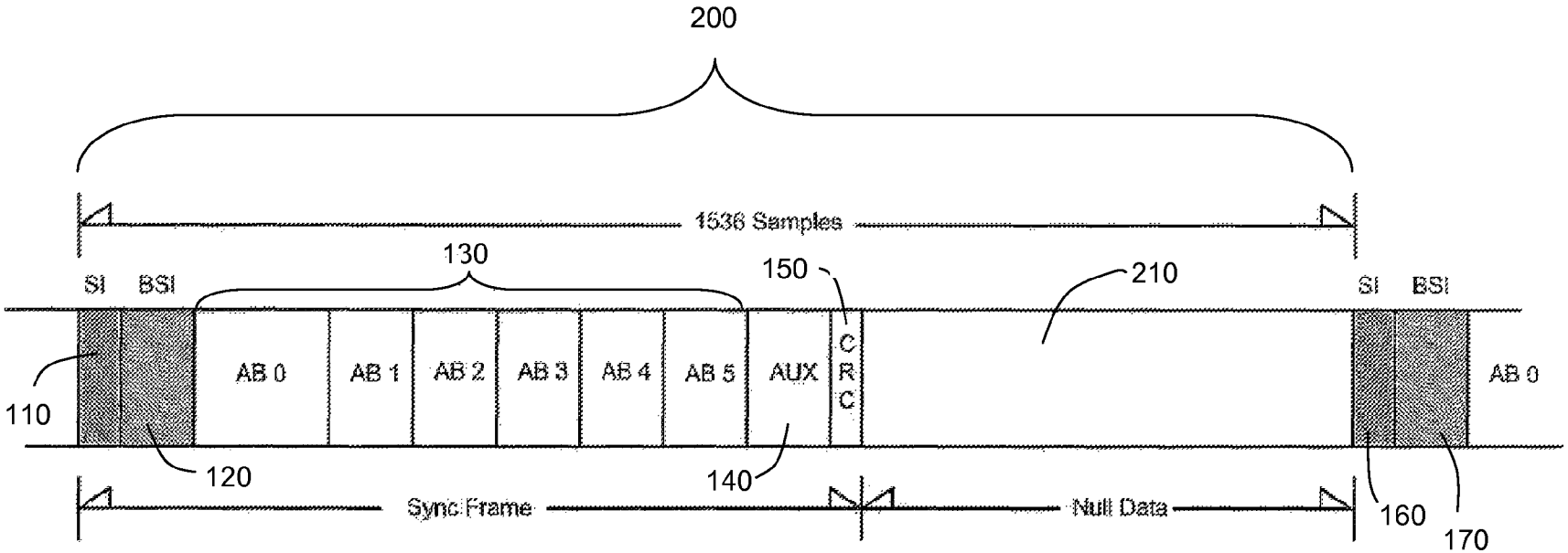
(Prior Art) Figure 2
FIG. 2 illustrates an example fixed length data structure or fixed frame.

FIG. 2 illustrates an example fixed length data structure or fixed frame 200. Fixed frame 200 includes null data 210 such that the length or size of the frame 200 is fixed (e.g. 1536 samples) . It can be seen that the insertion of the null data 210 results in a great deal of unused data space. It should also be noted that prior to storage or transmission of such a signal, the null data 210 would be removed. Simply inserting data into these null data space would result in this data being lost when the null data 210 is removed for transmission or storage from frame 200.

Figure 3:
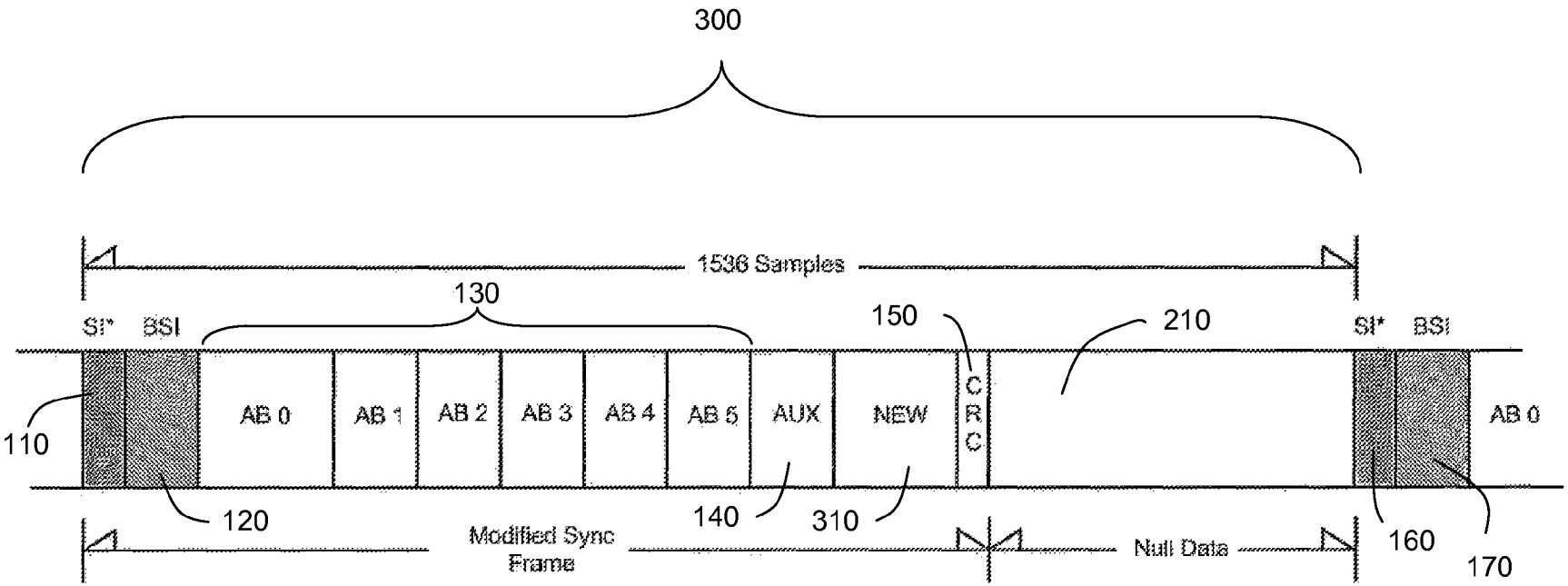
FIG. 3 illustrates an example modified encoded data frame.

FIG. 3 illustrates an example modified encoded data frame 300. Frame 300 includes an additional data block (marked New) 310, which has been inserted after the auxiliary data block 140 and before the CRC block 150. Additional data block 310 includes additional data. Additional data block 310 may include null data and may be of a suitable data length such that the data length of frame 300 is fixed. Thus, additional data block 310 may be used to rate shape the overall data rate of the bit stream to a fixed value. The additional data in additional data block 310 may also be any data related to the encoded data or it may be data unrelated to the encoded data. Examples of data that may be included in the additional data include, but are not limited to, advanced audio metadata, side channel data such as that used in ISO/IEC 23003-1 MPEG Surround, or any other type of data.

In one embodiment, the frame size code included in the synchronization information in SI block 110 may be updated to take into account the additional data. In one embodiment, CRC 150 may be updated to take into account the additional data.

Figure 4:
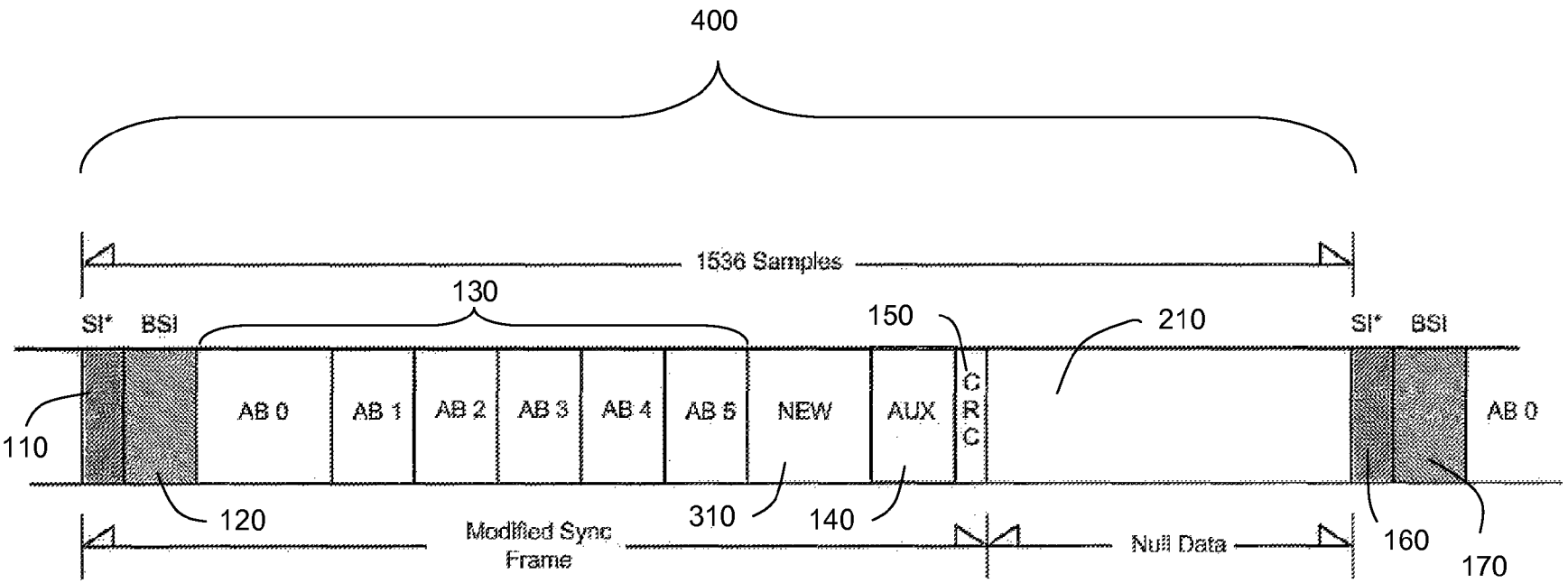
FIG. 4 illustrates an alternative example modified encoded data frame.

FIG. 4 illustrates an alternative example modified encoded data frame 400. Frame 400 also includes additional data block 310 except that, in the example embodiment, additional data block 310 has been inserted after the encoded data block 130 and before the auxiliary data block 140. Inserting additional data block 310 at this location allows auxiliary data block 140 to remain in the position immediately before CRC block 150. Having auxiliary data block 140 at this position may be necessary in some applications such as audience measurement systems that may expect stored data in auxiliary data block 140 to be located at that particular location.

While a certain number of data blocks in a certain order are illustrated, it is to be appreciated that a greater and/or lesser number of data blocks arranged in different orders can be present in example data structures.

Figure 5:
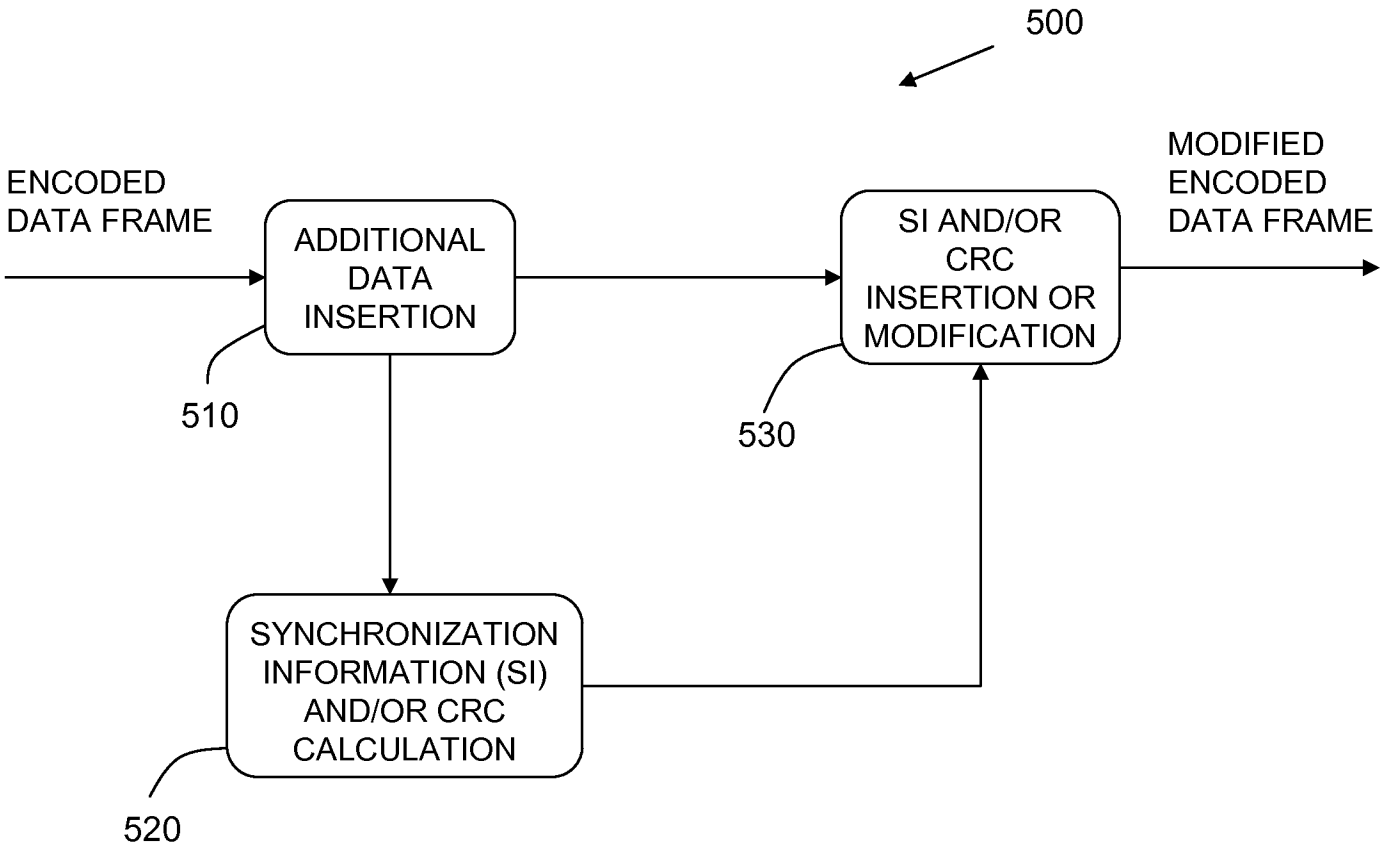
FIG. 5 illustrates a block diagram of an example system for adding additional data to encoded bit streams.

FIG. 5 illustrates a block diagram of an example system 500 for adding additional data to encoded bit streams. System 500 includes a first logic 510 which inserts an additional data block into a received encoded data frame. System 500 further includes a second logic 520 which calculates new synchronization information (SI) and/or a new CRC based on the encoded data frame with the additional data block inserted. System 500 further includes a third logic 530 which inserts the newly calculated SI and/or CRC to produce the modified encoded data frame. In an alternative embodiment, the pre-existing SI and/or CRC are modified to account for the insertion of the additional block.

A system for extracting the additional data from the modified encoded bit stream (not shown) may include logic for extracting the additional data block from the modified encoded data frame. The system for extracting the additional data from the modified encoded bit stream may further include a logic which calculates new synchronization information (SI) and/or a new CRC based on the modified encoded data frame with the additional data block extracted. The system for extracting the additional data from the modified encoded bit stream may also include logic which inserts the newly calculated SI and/or CRC to produce the encoded data frame. The SI and/or CRC may also be modified instead of newly inserted.

Figure 6:
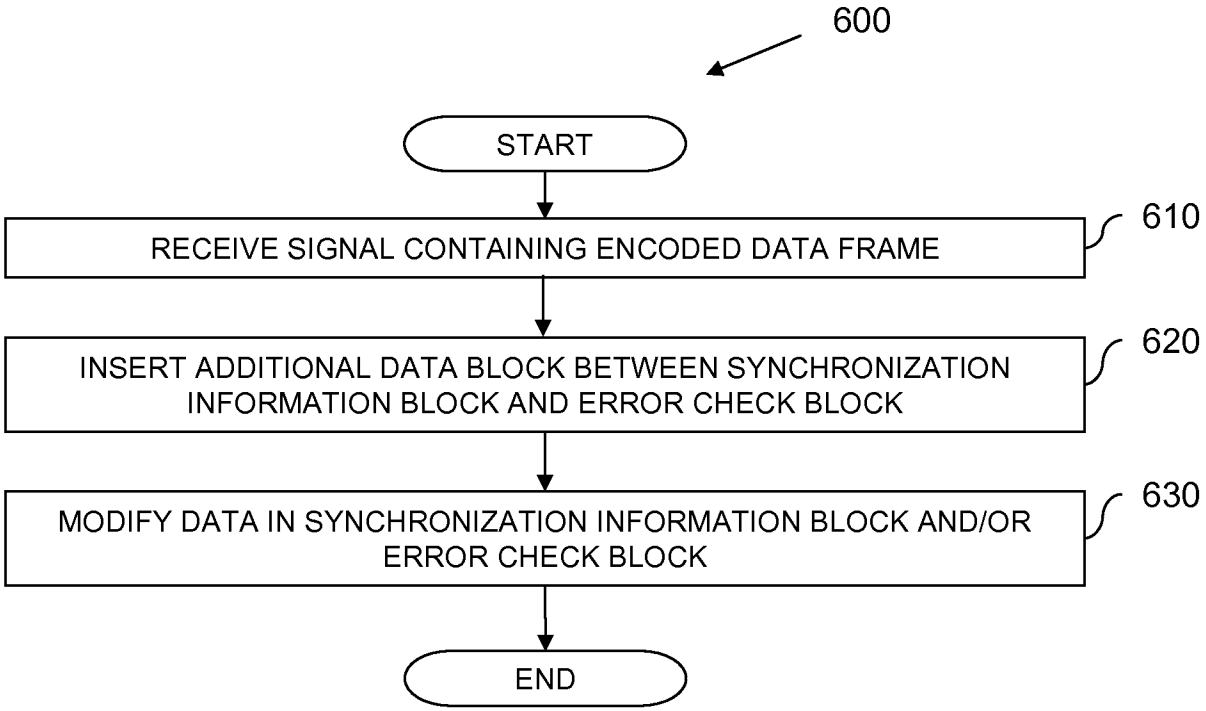
FIG. 6 illustrates an example method of adding additional data to an encoded data frame.
Figure 7:
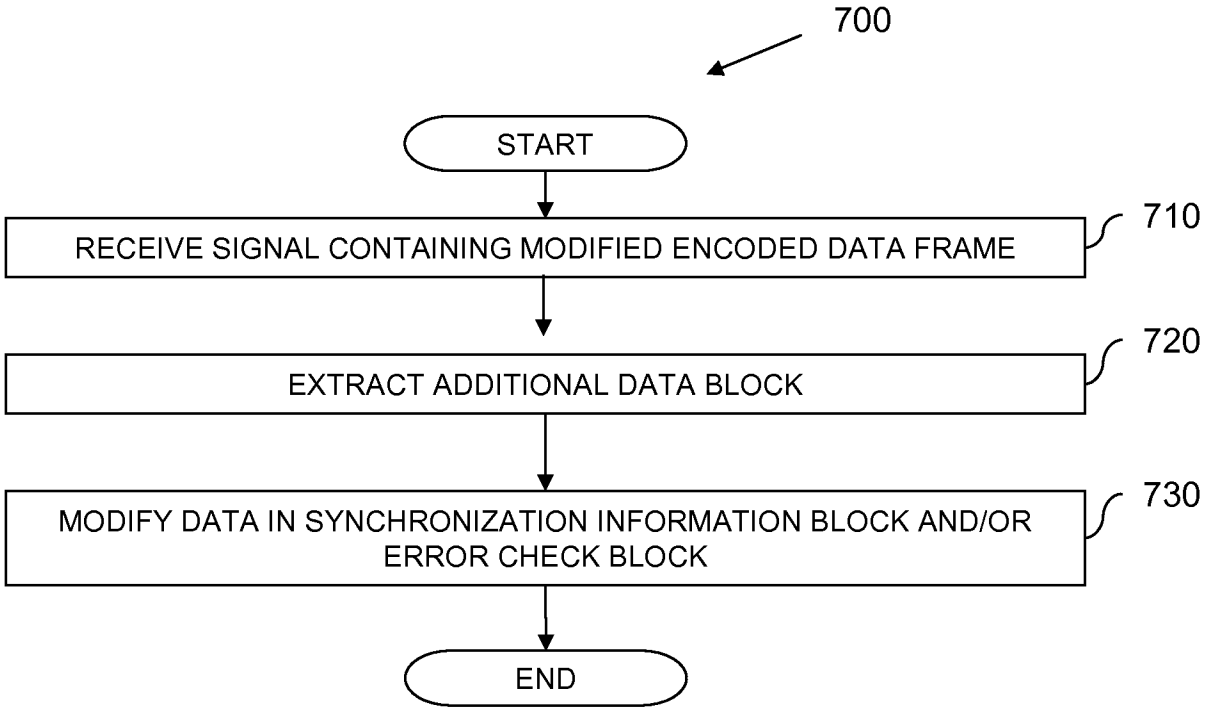
FIG. 7 illustrates an example method for extracting additional data from a modified encoded data frame.

Example methods may be better appreciated with reference to the flow diagrams of FIGS. 6 and 7. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Furthermore, additional and/or alternative methodologies can employ additional, not illustrated blocks.

In the flow diagrams, blocks denote "processing blocks" that may be implemented with logic. The processing blocks may represent a method step and/or an apparatus element for performing the method step. A flow diagram does not depict syntax for any particular programming language, methodology, or style (e.g., procedural, object-oriented) . Rather, a flow diagram illustrates functional information one skilled in the art may employ to develop logic to perform the illustrated processing. It will be appreciated that in some examples, program elements like temporary variables, routine loops, and so on, are not shown. It will be further appreciated that electronic and software applications may involve dynamic and flexible processes so that the illustrated blocks can be performed in other sequences that are different from those shown and/or that blocks may be combined or separated into multiple components. It will be appreciated that the processes may be implemented using various programming approaches like machine language, procedural, object oriented and/or artificial intelligence techniques.

In one example, methodologies are implemented as processor executable instructions and/or operations provided on a computer-readable medium. Thus, in one example, a computer-readable medium may store processor executable instructions operable to perform a method that includes the processes illustrated in FIGS. 6 and 7. While the above methods are described being provided on a computer-readable medium, it is to be appreciated that other example methods described herein can also be provided on a computer-readable medium.

While FIGS. 6 and 7 illustrates various actions occurring in serial, it is to be appreciated that various actions illustrated in the figures could occur substantially in parallel. While a certain number of processes are described, it is to be appreciated that a greater and/or lesser number of processes could be employed and that lightweight processes, regular processes, threads, and other approaches could be employed.

FIG. 6 illustrates a method 600 for adding additional data to an encoded data frame. At 610, a signal containing the encoded data frame may be received. The encoded data frame may be transformed into a modified encoded data frame by, at 620, inserting an additional data block between the encoded data block and the error check block, and, at 630, modifying data in at least one of the synchronization information block and the error check block to account for the inserting of the additional data block.

FIG. 7 illustrates a method 700 for extracting additional data from a modified encoded data frame. At 710, a signal containing the modified encoded data frame may be received. The modified encoded data frame may be transformed back to the encoded data frame by, at 720, extracting the additional data block, and, at 730, modifying data in at least one of the synchronization information block and the error check block to account for the extracting of the additional data block.

While example systems, methods, and so on, have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995) .

What is claimed is:

1. A method of adding additional data to an encoded data frame, the method comprising:

receiving a signal containing the encoded data frame, where the encoded data frame includes a plurality of data blocks, where the plurality of data blocks includes,
at least one synchronization information block,
at least one encoded data block, and
at least one error check block;

transforming the encoded data frame into a modified encoded data frame by
inserting at least one additional data block between immediately adjacent data blocks of the encoded data frame, where the at least one additional data block includes the additional data, and
modifying data in the at least one synchronization information block and the at least one error check block to account for the inserting of the at least one additional data block, wherein the modifying includes updating a frame size code included in the synchronization information block to account for an increase in the frame size due to the additional data.

2. The method of claim 1, where the encoded data frame and the modified encoded data frame encode underlying data, and where the additional data includes null data such that where the encoded data frame has a variable frame length that varies based, at least in part, on characteristics of the underlying data and a quality target, the modified encoded data frame has a fixed frame length.

3. The method of claim 1, where the encoded data frame has a first fixed frame length, and where the additional data includes null data such that the modified encoded data frame has a second fixed frame length different from the first fixed frame length.

4. The method of claim 1, where the encoded data frame and the modified encoded data frame encode audio data, where the encoded data frame has a variable length that varies based, at least in part, on characteristics of the audio data and an audio quality target, and where the modified encoded data frame has a fixed length.

5. The method of claim 1, where the encoded data frame encodes underlying data, and where the additional data includes metadata that describes the underlying data.

6. The method of claim 1, where the encoded data frame and the modified encoded data frame encode underlying data, and where the additional data enhances the underlying data.

7. The method of claim 1, further comprising:

receiving a signal containing the modified encoded data frame; and transforming the modified encoded data frame back to the encoded data frame by
extracting from the modified encoded data frame the at least one additional data block, and
modifying data in the at least one synchronization information block and the at least one error check block to account for the extracting of the at least one additional data block.

8. The method of claim 1, where the encoded data frame includes at least one auxiliary data block, and where the inserting the at least one additional data block includes inserting the at least one additional data block between the at least one auxiliary data block and the at least one error check block.

9. The method of claim 1, where the encoded data frame includes at least one auxiliary data block, and where the inserting the at least one additional data block includes inserting the at least one additional data block between the at least one encoded data block and the at least one auxiliary data block.

10. The method of claim 1, where the encoded data frame is an encoded AC-3 frame.

11. A system for inserting additional data into a previously encoded audio data frame, the system comprising:

at least one storage device; and at least one processor programmed to receive a signal containing the previously encoded audio data frame, where the previously encoded audio data frame includes a plurality of data blocks, where the plurality of data blocks includes, a first data block, and a second data block immediately adjacent the first data block;

insert at least one additional data block between the first data block and the second data block, where the at least one additional data block includes the additional data, and modify at least one of a synchronization data and an error check data to account for the insertion of the at least one additional data block, wherein modifying the synchronization data includes updating a frame size code to account for an increase in frame size due to the inserted at least one additional data block.

12. The system of claim 11, where the at least one additional data block includes null data such that, where the previously encoded audio data frame has a variable frame size, an encoded audio data frame modified by the inserting of the at least one additional data block has a fixed frame size.

13. The system of claim 11, where the previously encoded audio data frame has a first fixed frame size, and where the at least one additional data block includes null data such that an encoded audio data frame modified by the inserting of the at least one additional data block has a second fixed frame size different from the first fixed frame size.

14. The system of claim 11, where the additional data includes metadata that describes audio data encoded in the previously encoded audio data frame.

15. The system of claim 11, where the additional data enhances the audio data encoded in the previously encoded audio data frame.

16. The system of claim 11, where the previously encoded audio data frame is an encoded AC-3 frame.

17. A system for extracting additional data from a modified encoded audio data frame, the system comprising:

at least one storage device; and at least one processor programmed to receive a signal containing the modified encoded audio data frame;

extract from the modified encoded audio data frame at least one additional data block including the additional data such that at least two data blocks that were not immediately adjacent in the modified encoded audio data frame become immediately adjacent, and modify data in a synchronization information block and an error check block to account for the extracting of the at least one additional data block, wherein modifying data in the synchronization information block includes updating a frame size code to account for a decrease in frame size due to the inserted at least one additional data block.

* * * * *

UNITED STATES PATENT AND TRADEMARK OFFICE

CERTIFICATE OF CORRECTION

PATENT NO. : 8,527,267 B2
APPLICATION NO. : 12/631773
DATED : September 3, 2013
INVENTOR(S) : Timothy J. Carroll It is certified that error appears in the above-identified patent and that said Letters Patent is hereby corrected as shown below:

On the Title Page

Item (56) add the following publication under References Cited, OTHER PUBLICATIONS:

"MP3 and AAC Explained," K. Brandenburg, AES 17th International Conference on High Quality Audio Coding, September 2nd-5th, 1999.

Signed and Sealed this
Eighth Day of October, 2013

Teresa Stanek Rea

Teresa Stanek Rea
*Deputy Director of the United States Patent and Trademark Office*